United States Patent [19]

Silverthorn et al.

[11] Patent Number: 4,485,977

[45] Date of Patent: Dec. 4, 1984

[54] ROLLER MILL CONSTRUCTION

[75] Inventors: Charles R. Silverthorn; Ernest H. Sancken, both of Eureka, Ill.

[73] Assignee: A. O. Smith Harvestore Products Inc., Arlington Heights, Ill.

[21] Appl. No.: 405,303

[22] Filed: Aug. 4, 1982

[51] Int. Cl.[3] ..... B02C 4/38

[52] U.S. Cl. ..... 241/230; 241/290

[58] Field of Search ..... 241/230, 231, 232, 233, 241/234, 286, 290; 403/145, 146, 148, 149

[56] References Cited

U.S. PATENT DOCUMENTS 2,506,619 5/1950 Schwartz ..... 403/148 X 3,208,677 9/1965 Hesse ..... 241/230

OTHER PUBLICATIONS

"Krimper-Kracker Series 100", H. C. Davis Sons Manufacturing Co. Inc.

"Automatic Feed Processing Equipment", Automatic Equipment Mfg. Co.

*Primary Examiner*—Mark Rosenbaum

*Assistant Examiner*—Joseph M. Gorski

*Attorney, Agent, or Firm*—Andrus, Sceales, Starke & Sawall

[57] ABSTRACT

An improved roller mill construction. Material to be milled or ground such is fed through a discharge opening in a hopper to a pair of cooperating rolls that are mounted within a housing. The discharge opening is enclosed by a sliding gate which is biased to the closed position and can be be opened by manual operation of a pull rod. An adjustable setting mechanism is incorporated with the pull rod and enables the gate to be held at an infinite number of open positions. To adjust the spacing between the rolls, the shaft of one of the rolls is journalled within bearing assemblies that are mounted for sliding movement with respect to the housing. A rod is secured to each slidable bearing assembly and is threadedly connected to a shaft which carries a sprocket. By driving the sprockets in unison, the shafts will be rotated to thereby move the bearing assemblies and adjust the spacing between the rolls. The movable roll is mounted for yieldable movement away from the fixed roll by compression springs which are located around the shafts and bear between an abutment on the shaft and the housing. Adjustment of the spacing between the rolls can be accomplished without changing the spring tension.

9 Claims, 9 Drawing Figures

Fig. 7
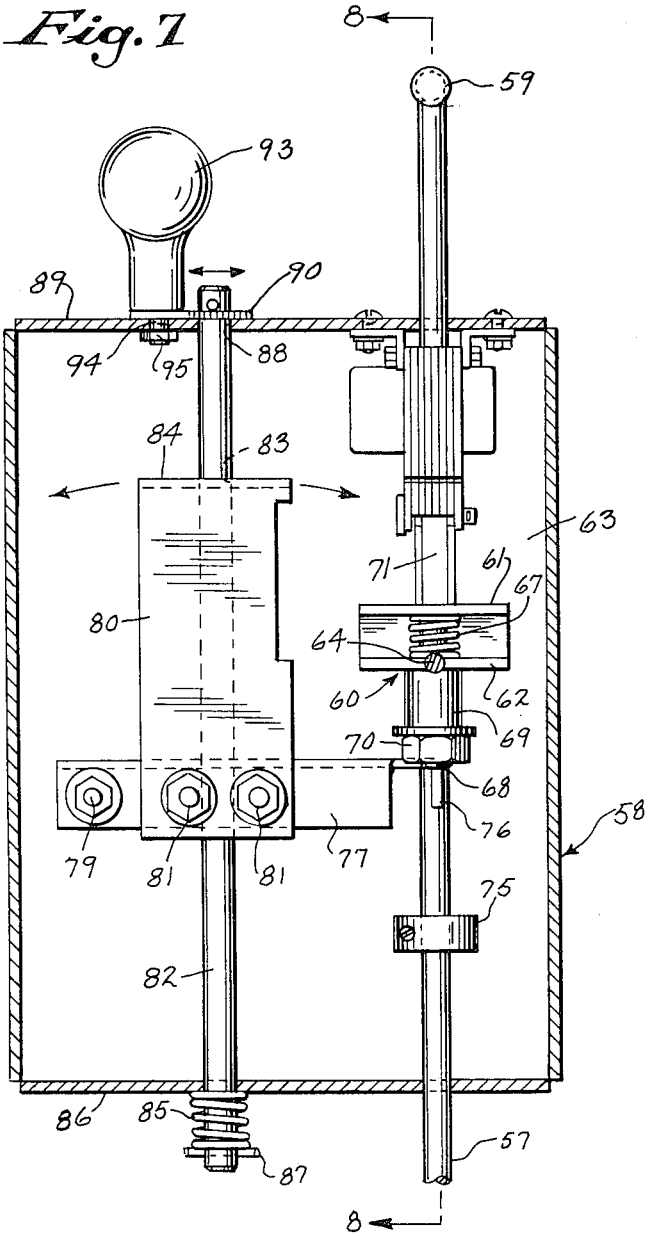
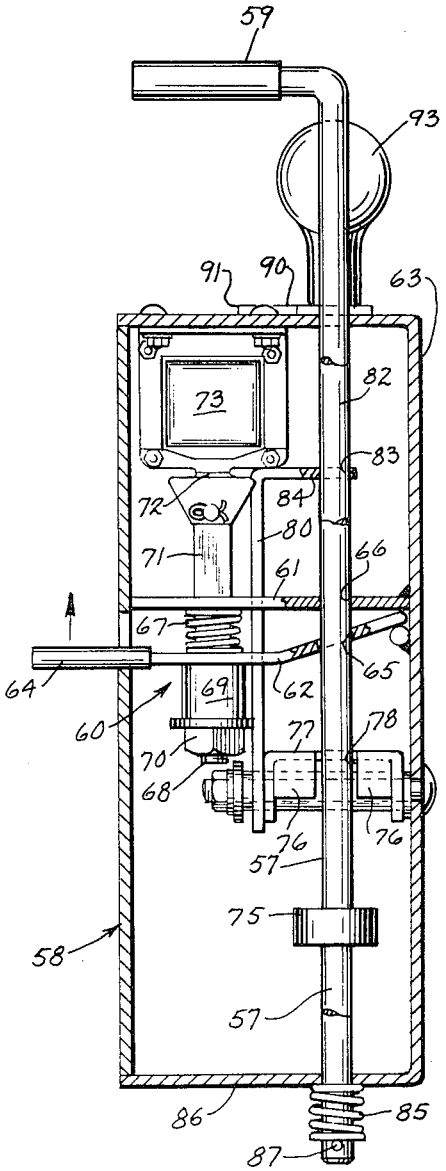
Fig. 8
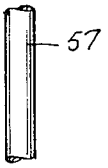
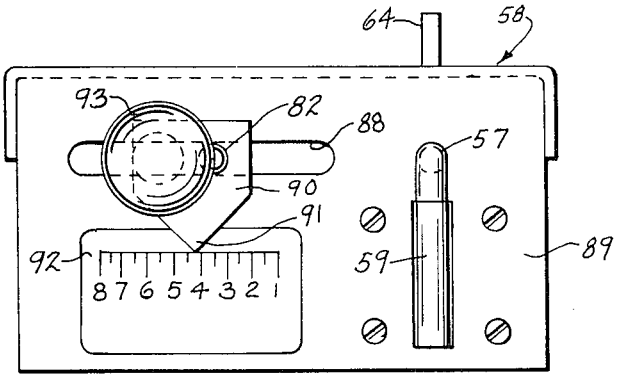
Fig. 9

ROLLER MILL CONSTRUCTION

BACKGROUND OF THE INVENTION

Roller mills include a pair of cooperating corrugated rolls that operate at different speeds to crack or grind material, such as high moisture grain. The grain is fed through a discharge opening in a hopper to the rolls which are mounted within a closed housing.

The typical roller mill has included a mechanism for varying the spacing between the rolls to regulate the degree of grain cracking or processing. To provide an adjustment of spacing, one of the rolls is fixed in position, while the shaft of the other roll is journalled within a pair of bearing assemblies that are mounted for sliding movement with respect to the housing. A rod is secured to each bearing assembly and is threadedly engaged with a shaft which carries a drive sprocket. By rotating the drive sprockets in unison, the shafts will be rotated to thereby move the bearing assemblies and the movable roll relative to the fixed roll. With the adjusting mechanism, as used in the past, a compression spring was mounted around the rod and was seated between a nut threaded on the rod and the housing. The spring biased the movable roll toward the fixed roll and yet was yieldable so that if an enlarged object passed between the rolls, the movable roll would move outwardly to accommodate the enlargement. With the adjusting system as used in the past, rotation of the sprockets to vary the spacing was done manually and due to the substantial force exerted by the springs, rotation of the sprockets through an operating handle was difficult and required substantial force, meaning that the operator would normally have to apply a wrench or pipe to the operating handle in order to produce sufficient leverage to rotate the sprockets against the force of the springs.

As a further disadvantage, the adjusting mechanisms as used in the past, varied the spring force with the adjustment of the rolls, meaning that as the spacing between the rolls was increased, the springs would be further compressed, thereby increasing the spring force. This meant that the force necessary to release the roll to accommodate an enlargement varied with the spacing between rolls.

Roller mills, as used in the past, have also included a mechanism for varying the effective area of the discharge opening in the hopper. The discharge opening is normally enclosed by a sliding gate which is spring biased to a closed position and can be moved to an open position through a manually operated pull rod. A collar associated with the pull rod is adapted to engage an adjustable stop to regulate the effective size of the discharge opening and thereby control the flow of grain to the rolls. With the roller mills as used in the past, the stop has consisted of a series of fingers mounted on a rotatable shaft, and by rotating the shaft through a manual control, the fingers could be selectively positioned to be engaged by the stop to thereby limit the movement of the pull rod and vary the size of the discharge opening. With mechanisms of this type as used in the past, the stop fingers were positioned at various intervals along the length of the rod and there was no infinite adjustment of the effective area of the discharge opening.

SUMMARY OF THE INVENTION

The invention relates to a roller mill and more particularly to an improved mechanism for adjusting the spacing between the rolls, as well as an improved mechanism for controlling the flow of feed to the rolls.

The material is fed through a discharge opening in a hopper to a housing which contains a pair of cooperating, oppositely rotating rolls that act to process or crack the grain or other material. The shaft of one of the rolls is journalled within a pair of fixed bearing assemblies, while the shaft of the other roll is journalled within bearing assemblies which are mounted for sliding movement relative to the housing. By moving the bearing assembles relative to the housing, the spacing between the two rolls can be varied to control the processing or cracking of the grain.

In accordance with the invention, a rod is secured to each movable bearing assembly and extends laterally with respect to the axis of the movable roll. The outer end of each rod is threaded within the head of a take-up bolt, while the end of each bolt is secured to a sprocket located on the outside of the housing. The two sprockets are joined by a chain so that manual rotation of one of the sprockets through a handle will cause the sprockets to rotate in unison to thereby move the movable roll toward and away from the fixed roll.

To provide a yieldable support for the movable roll, a compression spring is mounted on each take-up bolt and is interposed between the head of the bolt and the wall of the housing. If an enlarged object enters the nip between the cooperating rolls, the movable roll will move outwardly against the force of the spring to permit the enlargement to pass between the rolls. With this construction, the force of the spring which generally has a force of about 2500 to 3000 lbs. is not exerted on the threaded connection of the adjusting bolt and therefore, the bolt can be readily turned with minimum force to provide the spacing adjustment.

As a further advantage, adjustment of the take-up bolts does not effect the tension on the springs, as occurred in prior art mechanisms. Therefore, the tension on the yieldable springs remains the same, regardless of the spacing between the rolls.

The roller mill of the invention also includes an improved mechanism for controlling the flow of feed from the hopper to the roll housing. In this regard, the lower end of the hopper is provided with a discharge opening that is enclosed by a gate that is mounted for sliding movement on the outer surface of the hopper. The gate is spring loaded to a closed position and can be opened through manual operation of a pull rod.

To hold the gate in the open position, an automatic locking mechanism is associated with the pull rod which will hold the rod in an open position until manually released. To vary the size of the effective opening in the hopper, a collar is mounted on the pull rod, which is adapted to engage an infinitely adjustable stop, to thereby limit the movement of the pull rod and determine the effective size of the discharge opening.

Other objects and advantages will appear in the course of the following description.

DESCRIPTION OF THE DRAWINGS

The drawings illustrate the best mode presently contemplated of carrying out the invention.

In the drawings:

FIG. 7 is a section taken along line 7—7 of FIG. 5 showing the operating mechanism for the gate;

FIG. 8 is a section taken along line 8—8 of FIG. 7; and

FIG. 9 is an end view of the housing for the gate control mechanism,

DESCRIPTION OF THE ILLUSTRATED EMBODIMENT

Figure 1:
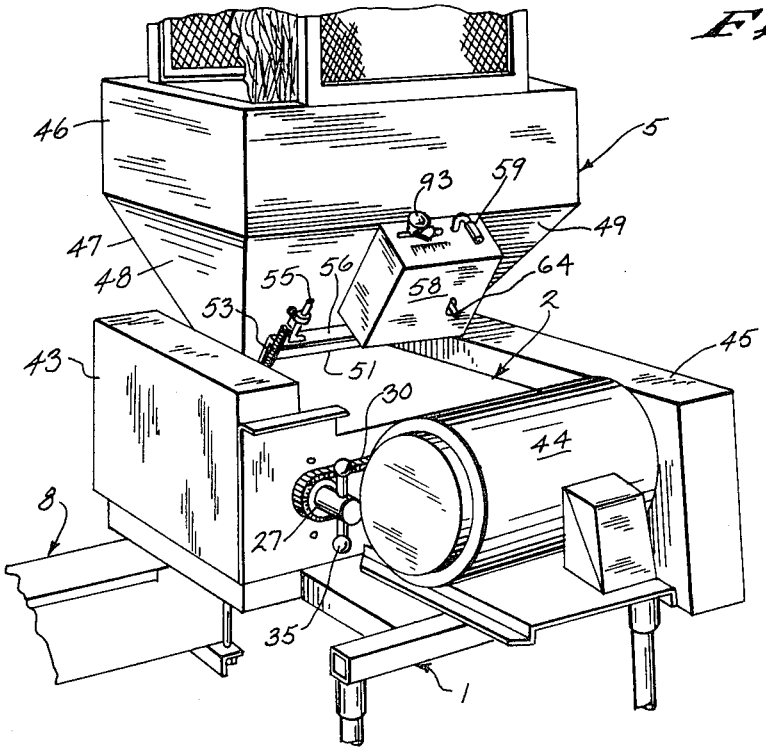
FIG. 1 is a perspective view of the roller mill of the invention.
Figure 3:
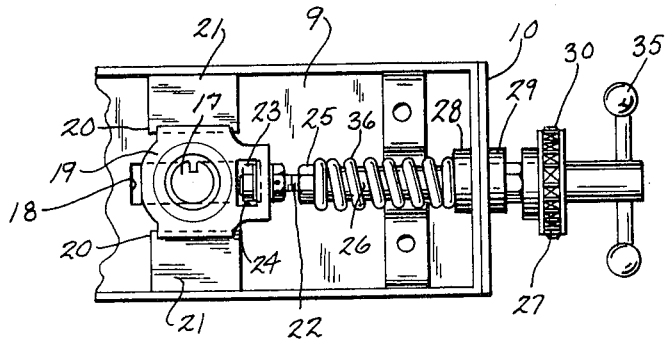
FIG. 3 is a fragmentary side elevation of the adjusting mechanism.

FIG. 1 illustrates a roller mill of the invention which includes a supporting frame 1 on which is mounted a roller mill base or housing 2. A pair of cooperating rotating rolls 3 and 4 are mounted within the base and serve to grind or crack the grain or other material introduced into the housing.

The grain is fed to the housing 2 through a hopper 5 having a discharge opening 6 in the lower end which communicates with the housing 2. After cracking, the grain is discharged from the housing 2 through an outlet formed in the bottom of housing 2 to a discharge auger conveyor 8 which conveys the grain to a suitable conveyor system or storage location.

Figure 2:
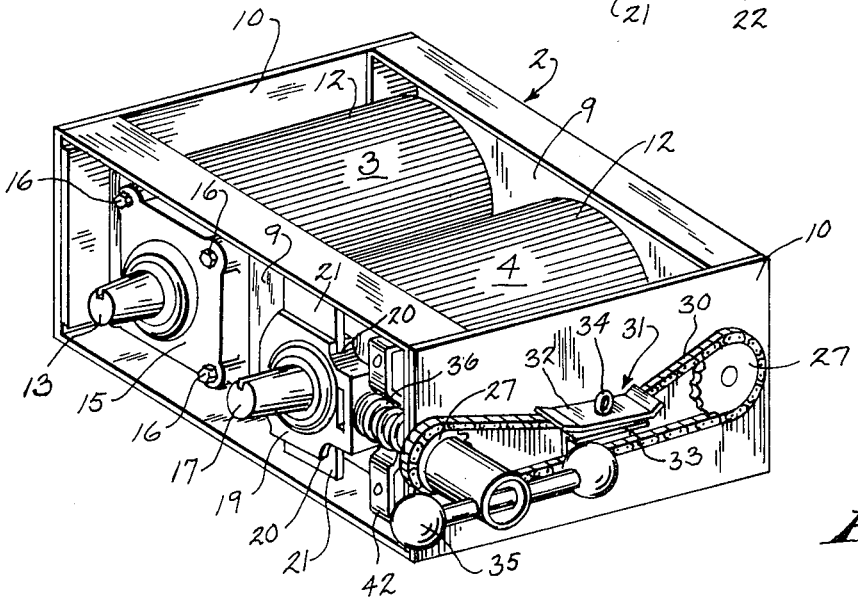
FIG. 2 is a perspective view of the roller housing showing the mechanism for adjusting the spacing between rollers.

The roller mill housing 2, as best illustrated in FIG. 2, includes a pair of side walls 9 which are connected at their ends by end walls 10. An agitator 11 is mounted in the lower end of hopper 5 directly above the rolls 3 and 4, and rotation of agitator 11 will agitate the grain or material in the hopper and prevent the grain from bridging over in the hopper.

Each roll 3 and 4 is provided with a plurality of longitudinal ribs or corrugations 12 which extend the full length of the roll. Shaft 13 of roll 3 extends through openings formed in the respective side walls 9 and the ends of shaft 13 are journalled within bearing assemblies 15 secured by bolts 16 to the respective side walls 9. Roll 4 is mounted for movement toward and away from roll 3 and to provide this movement, the ends of shaft 17 of roll 4 extend through slots 18 in side walls 9, and are journaled within bearing assemblies 19 which are mounted for horizontal sliding movement with respect to the side walls 9. More particularly, the upper and lower surfaces of each bearing assembly 19, as illustrated in FIG. 2 are provided with grooves 20 which receive guide plates 21 attached to the side walls 9.

To vary the spacing between rolls 3 and 4, one end of a threaded rod 22 extends through an opening in the side of each bearing assembly 19 and is threaded to a nut 23 contained in recess 24 in the bearing assembly. The outer end of each rod 22 is threaded within an opening in the head 25 of a take-up bolt 26. Each bolt 26 extends through an opening in end wall 10, and the end of bolt 26 is threaded within an opening in sprocket 27. A set screw, not shown, is employed to lock each bolt 26 to the respective sprocket 27 to prevent relative rotational movement between the two members. A pair of thrust washers 28 and 29 are positioned around each bolt 26 and are located on opposite sides of end wall 10.

Sprockets 27 are connected by chain 30 and the chain travels within a guide bracket 31 that is mounted for adjustable vertical movement on end wall 10. As shown in FIG. 2, the chain passes between upper section 32 and lower section 33 of bracket 31, and by vertical adjustment of the bracket on wall 10, the tension on chain 30 can be varied. To lock the chain 30 and the sprockets 27 in position, pin 34 is inserted through aligned slots in sections 32 and 33 and through a link of the upper run of the chain.

Handle 35 is connected to one of the sprockets 27, as illustrated in FIG. 2, and to adjust the spacing between rolls 3 and 4, the handle 35 is rotated causing sprockets 27 to rotate un unison through the chain drive 30. Rotation of sprockets 27 will cause corresponding rotation of bolts 26, causing threaded movement of rods 22 relative to bolts 26 to thereby vary the spacing between rolls 3 and 4.

To provide a yieldable support and enable roll 4 to move outwardly away from roll 3 in the event an incompressible object enters the nip between the rolls, a compression spring 36 is interposed between head 25 of each bolt 26 and thrust washer 28. The force of the springs 26 urges the roll 4 in a direction toward roll 3 and engagement of thrust washer 29 with the outer surface of wall 10 limits the inward position of roll 4.

With this construction, the force of springs 36 is not exerted on the threaded connection between bolts 26 and rods 22, so that the sprockets 27 can be rotated through handle 35 with minimum force to provide the spacing adjustment. As a further advantage, adjustment of the spacing of the rolls 3 and 4 does not effect the compression of springs 36, so that the spring force remains the same, regardless of the roll spacing. As previously noted, springs 36 serve to bias the roll 4 to its operative position, and if an enlargement or incompressible object enters the nip between rolls 3 and 4 the roll 4 can move outwardly against the force of springs 36 to accommodate the object.

Figure 4:
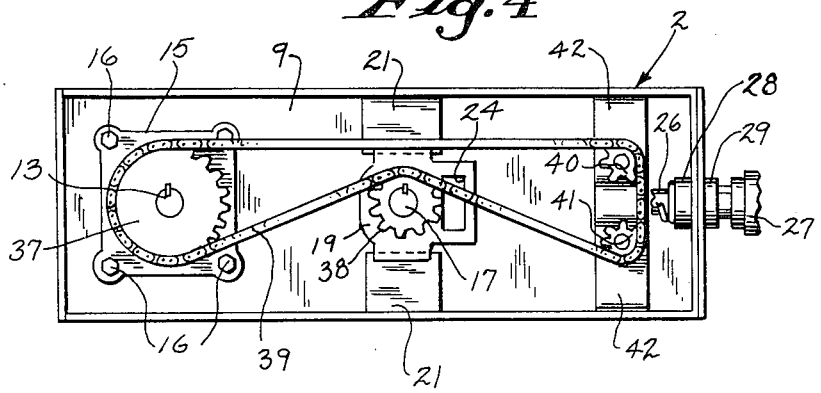
FIG. 4 is a side elevation showing the drive connection between rollers.

Rolls 3 and 4 are driven in opposite direction by a conventional chain drive. A sprocket 37 is mounted in the end of roll shaft 13 and similarly a sprocket 38 is mounted on the end of roll shaft 17. Chain 39 is engaged with sprockets 37 and 38, as well as a pair of idler sprockets 40 and 41, as shown in FIG. 4. Sprockets 40 and 41 are mounted for rotation on bracket 42 shown in FIG. 2. Through this chain drive connection, the rolls 3 and 4 will be rotated in opposite directions. Shroud 43 is secured to the side wall 9 of housing 2 and encloses the chain drive 39.

Motor 44 provides the power source for rotating the rolls 3 and 4. Motor 44 is mounted on the frame 1 and the drive shaft of the motor is connected by a chain drive, not shown, to the end of shaft 13 of roll 3. The chain drive connecting motor 44 to shaft 13, is enclosed by shroud 45. With this drive connection, motor 44 drives roll 3, and rotation of roll 3 is transmitted via chain drive 39 to roll 4.

The invention also includes an improved mechanism for controlling the feed of material from hopper 5 to roller housing 2. Hopper 5 includes a generally rectangular upper section 46 and a converging lower section 47. Lower section 47 is formed from a pair of side walls 48 which are connected along their edges by tapered end walls 49.

Figure 6:
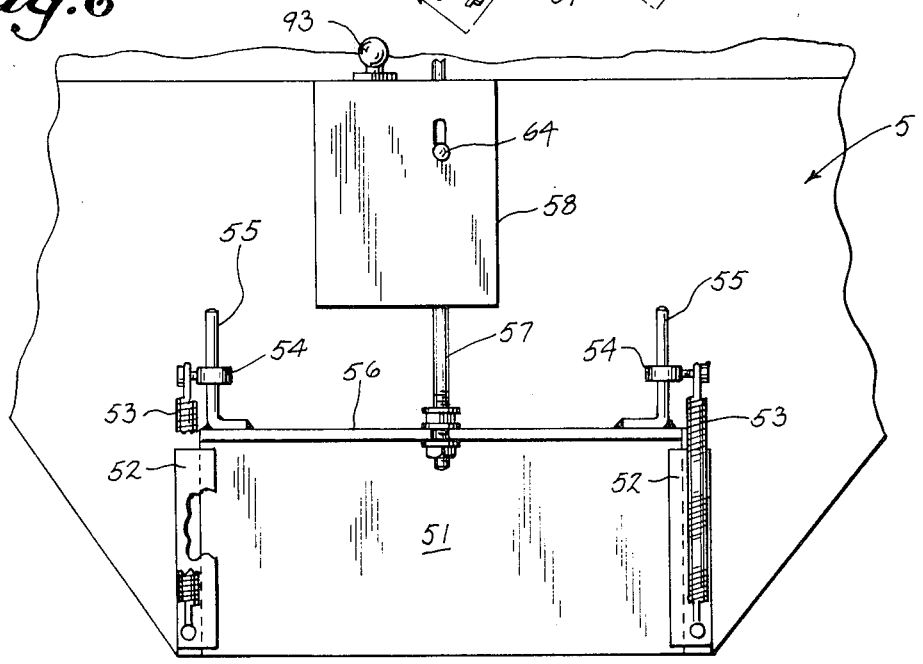
FIG. 6 is a view taken along line 6—6 of FIG. 5.

Material is discharged from hopper 5 to roller housing 2 through discharge opening 6 formed in one of the walls 49 and the discharge opening is closed off by a sliding gate 51. As best shown in FIG. 6, the side edges of gate 51 are mounted for sliding movement within angle-shaped guides 52 which are mounted on wall 49.

Figure 5:
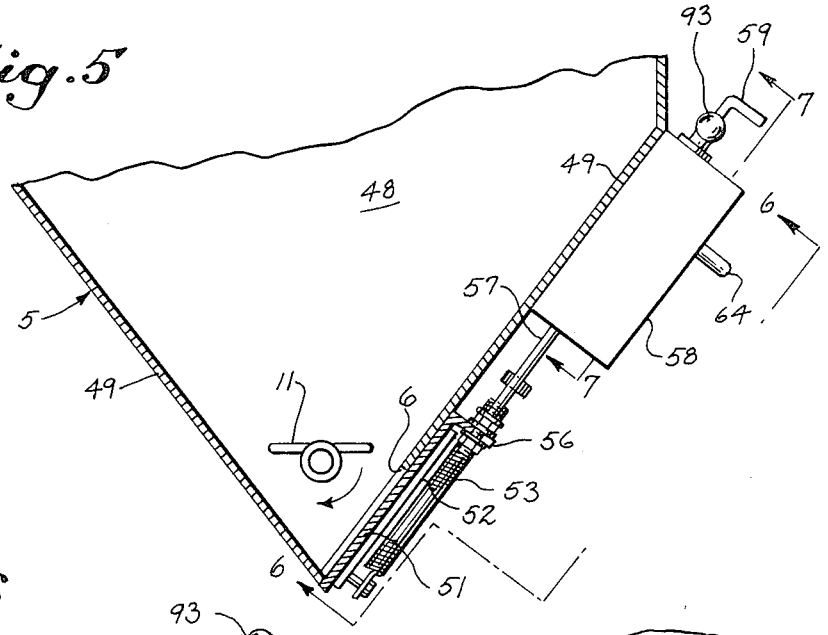
FIG. 5 is a vertical section showing the mechanism for operating the discharge gate in the hopper.

As best illustrated in FIGS. 5 and 6, gate 51 is biased to the closed position by a pair of extension springs 53. The lower end of each spring 53 is attached to the hopper 5, while the upper end of each spring is engaged with a collar 54 that is mounted for adjustable movement on rod 55. Rods 55 extend upwardly from the upper flange 56 of gate 51. With this arrangement, the force of springs 53 urge the gate 51 downwardly to a closed position.

Gate 51 can be moved upwardly to the open position through operation of the pull rod 57 which is connected to upper flange 56 of gate 51. Pull rod 57 extends upwardly through a generally rectangular casing or housing 58, and the projecting upper end of pull rod 57 defines a handle 59. By pulling upwardly on handle 59, gate 51 can be moved to the open position.

A locking mechanism, indicated generally by 60, is contained in casing 58 and serves to automatically lock gate 51 in an open position. The locking mechanism, best illustrated in FIGS. 7 and 8, is in itself conventional and forms no part of the present invention. Locking mechanism 60 includes a pair of plates 61 and 62 which are spaced apart, as shown in FIG. 8. Plate 61 is fixed, while plate 62 is pivotally connected to the upper surface 63 of casing 58. The outer end of plate 62 defines a handle 64 which projects through an opening in the lower surface of casing 58.

Pull rod 57 extends through a slot 65 in pivotable plate 62 and through an aligned opening 66 in plate 61. Spring 67 is positioned between plates 61 and 62 and urges plate 62 away from plate 61. By pulling upwardly on pull rod 57, plate 62 will pivot upwardly toward plate 61, permitting free movement of the pull rod. On release of the pull rod, spring 67 will urge plate 62 away from plate 61 to provide a binding connection between pull rod 57 and slot 65 to thereby hold the pull rod and gate 51 in position.

To release pull rod 57 and enable the springs 53 to close gate 51, the handle 64 is moved upwardly, compressing spring 67 and thereby releasing the binding connection between the plate 62 and pull rod 57, so that the gate 51 can then move freely downwardly under the force of the springs 53.

In addition to the manual release, an automatic release can be incorporated in which gate 51 can be closed by remote control, as opposed to manual operation of handle 64. In this regard, bolt 68 extends through aligned openings in plates 61 and 62, as well as through spring 67. An annular spacer 69 is positioned around bolt 68 and extends between plate 62 and nut 70 threaded on the end of the bolt 68. The opposite end of bolt 68 is connected to a pair of arms 71 which are, in turn, connected to a plunger 72 of solenoid 73. By energizing solenoid 73, plunger 72 will be moved inwardly drawing the bolt 68 and plate 62 in a direction toward fixed plate 61 to release the binding engagement between pull rod 57 and plate 62.

During operation of the roller mill it is frequently desired to adjust the open position of gate 51 to control the flow of grain to the rollers 3 and 4. To control the open position of the gate and thereby regulate the effective size of the discharge opening 6, as shown in FIGS. 7 and 8, a collar 75 is clamped to pull rod 57, and as the rod is pulled upwardly, collar 75 is adapted to engage a pair of stops 76 formed on one end a pivotable bracket 77 to limit upward movement of the pull rod and thereby establish the open position of the gate. Stops 76 straddle central slot 78 in bracket 77 which receives pull rod 57. The opposite end of bracket 77 is pivotally connected to casing 58 by pivot 79 and an angle bracket 80 is connected to the central portion of bracket 77 by bolts 81.

As shown in FIGS. 7 and 8, operating rod 82 extends through aligned openings in opposite ends of the casing 58 as well as through an opening 83 in the downwardly extending flange 84 on bracket 80. Compression spring 85 is mounted around the projecting end of rod 82 and seats between the wall 86 of casing 58 and pin 87. The force of spring 85 urges the rod in a direction toward pin 87 and eliminates sloppiness in rod movement.

The opposite end of rod 82 extends through an elongated slot 88 in the opposite wall 89 of casing 58 and a pointer 90 is mounted on the projecting end of rod 82. Pointer 90 is provided with tip 91 that is adapted to be moved along a graduated scale 92 mounted on wall 89. Knob 93 is provided with the threaded stem 94 which extends through an opening in pointer 90 and through wall 89 and is threaded to nut 95 located on the outside of wall 89.

To change the setting for the open position of the gate 51, the knob 93 is rotated to loosen its threaded connection with nut 95, and the knob 93, along with rod 82, is moved laterally causing the pointer 90 to move to the desired setting on scale 92. Pivotal movement of rod 82 will pivot bracket 77 about pivot 79, thereby moving the position of stops 76. The adjusting mechanism functions in the form of a crank arm which is pivoted at 79 with one end of the crank arm defining the stops 76, while the opposite end of the crank arm is connected to the operating rod 82.

The adjusting mechanism, as illustrated in FIGS. 7 and 8, provides an infinite adjustment for the position of stops 76, so that the gate 51 can be set at any desired position. This is a substantial advantage over prior art structures in which the adjustment was in increments and did not include an infinite setting.

Various modes of carrying out the invention are contemplated as being within the scope of the following claims particularly pointing out and distinctly claiming the subject matter which is regarded as the invention.

We claim:

1. A roller mill construction, comprising a housing defining a chamber and including a pair of opposed first walls bordering said chamber, a first roll disposed within the chamber and having a first shaft journalled within said walls, a second roll disposed in the chamber and having the second shaft, bearing means mounted for sliding movement with respect to each wall in a first direction toward the first roll and in a second direction away from said first roll, ends of said second shaft being journaled within respective bearing means, a first elongated member secured to each bearing means and extending in said second direction, a second elongated member threadedly connected to an end of each first member, a drive element directly connected to each second elongated member, an abutment on each second elongated member, biasing means extending between each abutment and said housing for urging the respective bearing means in said first direction, connecting means interconnecting the drive elements, and drive means operably connected to at least one of said drive elements to thereby rotate the drive elements in unison and thereby adjust the threaded connection between said elongated members to vary the position of the bearing means and said second roll relative to said first roll.

2. The construction of claim 1, wherein said housing includes a pair of spaced second walls connecting the ends of the first walls, said biasing means extending between each abutment and one of said second walls.

3. The construction of claim 2, wherein said abutment is located radially outward of the threaded connection between said members.

4. The construction of claim 1, wherein said biasing means comprises a compression spring extending between the abutment and said housing.

5. The construction of claim 1, wherein said drive elements are sprockets and said connecting means comprises a chain interconnecting the sprockets.

6. A roller mill construction, comprising a housing defining a chamber and including a pair of opposed walls bordering said chamber, a first roll disposed within the chamber and having a first shaft journalled within said walls, a second roll disposed in the chamber and having a second shaft, bearing means mounted for sliding movement with respect to each wall in a first direction toward the first roll and in a second direction away from said first roll, ends of said second shaft being journaled within respective bearing means, a rod secured to each bearing means and extending in said second direction, a pair of bolts each including a head and a free end, each rod being threadedly connected with an opening in one of said bolt heads, each bolt extending through an opening in said housing, a drive element directly connected to the free end of each bolt, connecting means interconnecting the drive elements, drive means operably connected to at least one of said drive elements to rotate the drive elements in unison, and a spring disposed around each bolt and positioned between the bolt head and said housing, a force of said spring urging said bearing means in said first direction, rotation of said drive elements changing the threaded connection between said rod and said bolt to thereby move said bearing means and vary the spacing between said rolls, the force of said spring remaining unchanged as the spacing between the rolls is varied.

7. The construction of claim 6, wherein said housing includes a second wall and said bolts extend through said second wall, said construction also includes thrust bearing means disposed around each bolt and positioned on opposite sides of said second wall.

8. The construction of claim 7, wherein said spring is a compression spring and is interposed between bolt head and the respective thrust bearing means.

9. The construction of claim 6, wherein said drive means comprises a handle connected to one of said drive elements.

* * * * *

UNITED STATES PATENT AND TRADEMARK OFFICE

CERTIFICATE OF CORRECTION

PATENT NO. : 4,485,977

DATED : December 4, 1984

INVENTOR(S) : CHARLES R. SILVERTHORN ET AL

It is certified that error appears in the above-identified patent and that said Letters Patent is hereby corrected as shown below:

Abstract, Line 6, Cancel "be" (second occurrence); Col. 8, line 24, CLAIM 8, Before "bolt" insert ---the---; Col. 8, line 25, CLAIM 8, Cancel "the".

Signed and Sealed this

*Ninth* Day of *July 1985*

[SEAL]

*Attest:*

DONALD J. QUIGG

*Attesting Officer* *Acting Commissioner of Patents and Trademarks*